US009045876B2

(12) United States Patent
Laugwitz et al.

(10) Patent No.: US 9,045,876 B2
(45) Date of Patent: Jun. 2, 2015

(54) CONNECTION BRACKET AND TAMPING DEVICE HAVING SUCH A CONNECTION BRACKET AND METHOD FOR THE PRODUCTION THEREOF

(75) Inventors: Niels Laugwitz, Lannstein (DE); Werner Nick, Maisborn (DE); Heinz Nick, Emmelshausen (DE); Martin Dettmer, Hagen (DE)

(73) Assignee: BOMAG GmbH, Boppard (DE)

( * ) Notice: Subject to any disclaimer, the term of this patent is extended or adjusted under 35 U.S.C. 154(b) by 258 days.

(21) Appl. No.: 13/462,080

(22) Filed: May 2, 2012

(65) Prior Publication Data

US 2012/0282028 A1 Nov. 8, 2012

(30) Foreign Application Priority Data

May 2, 2011 (DE) ..... 10 2011 100 154

(51) Int. Cl.
*E01C 19/30* (2006.01)
*E02D 3/00* (2006.01)

(52) U.S. Cl.
CPC ..... *E02D 3/00* (2013.01)

(58) Field of Classification Search
USPC ..... 404/133.05, 133.1
See application file for complete search history.

(56) References Cited

U.S. PATENT DOCUMENTS 2,677,355 A * 5/1954 Maurer et al. ..... 74/44
3,109,354 A * 11/1963 Van Kirk ..... 404/133.1
3,782,845 A * 1/1974 Briggs et al. ..... 404/133.1
3,856,426 A 12/1974 Waschulewski et al.
4,848,989 A * 7/1989 Maeda ..... 55/319
5,957,622 A * 9/1999 Vera-Montiel ..... 404/133.1
6,994,059 B2 * 2/2006 Greppmair ..... 123/73 AD
7,896,575 B2 * 3/2011 Schulenberg et al. ..... 404/133.1
2004/0079305 A1 * 4/2004 Greppmair ..... 123/73 AD
2010/0189501 A1 * 7/2010 Grabnic et al. ..... 404/133.05
2011/0091279 A1 * 4/2011 Kuerten ..... 404/133.1

FOREIGN PATENT DOCUMENTS

DE 22 36 371 C2 10/1973
DE 201 03 666 U1 5/2001
DE 102009017209 A1 * 11/2010 ..... E02D 3/046
JP 2002-195112 A 7/2002

OTHER PUBLICATIONS

Espacenet, English Translation of DE 201 03 666 U1, retrieved from http://worldwide.espacenet.com/publicationDetails/description?CC=DE&NR=20103666U1&KC=U1&FT=D&ND=3&date=20010503&DB=worldwide.espacenet.com&locale=en_EP on Apr. 30, 2012 (6 pages).
ESPACENET, English Computer Translation of JP 2002-195112 (7 pages).

* cited by examiner

*Primary Examiner* — Abigail A Risic
(74) *Attorney, Agent, or Firm* — Wood, Herron & Evans, LLP

(57) ABSTRACT

The present invention relates to a connection bracket for a tamping device, comprising a frame, a guide element mount, and a drive element mount, the connection bracket having a guide unit implemented integrally therewith for combustion air, in particular an air filter attachment such as an air filter socket. In addition, the present invention relates to a tamping device which has such a connection bracket and a method for producing such a connection bracket or for assembling such a tamping device.

19 Claims, 13 Drawing Sheets

CONNECTION BRACKET AND TAMPING DEVICE HAVING SUCH A CONNECTION BRACKET AND METHOD FOR THE PRODUCTION THEREOF

CROSS-REFERENCE TO RELATED APPLICATIONS

The present application claims priority under 35 U.S.C. §119 of German Patent Application No. DE 10 2011 100 154.2, filed May 2, 2011, the disclosure of which is hereby incorporated herein by reference in its entirety.

FIELD OF THE INVENTION

The present invention relates to a connection bracket and mounting bracket, respectively, for a tamping device, in particular a vibration tamper and rammer, respectively, in the area of soil compaction devices. In addition, the present invention relates to an injection mold for producing such a connection bracket, a tamping device, in particular a vibration tamper, having such a connection bracket, and a method for the production of such a connection bracket and for the assembly of such a tamping device.

BACKGROUND OF THE INVENTION

Connection brackets, or tamping devices which are equipped with such connection brackets, are generally known from the prior art.

Known tamping devices typically have a compaction unit, for example, an oscillating ground plate, which can be driven via a suitable drive unit, in particular an internal combustion engine. The drive unit, also referred to hereafter as a drive element, is attached via a drive element mount on a connection bracket, on which the air filter unit for the drive unit and at least one guide element are frequently additionally attached via intermediate elements. The guide element can be a guide bow, for example, in order to allow the manual control of the tamping device.

In the tamping devices heretofore known from the prior art, the air filter system occupies a very large amount of space, and the integration of the air filter system into the overall design is generally only implementable heretofore with substantial effort and with a plurality of different components.

A bracket is frequently provided, on which a plurality of different components and, in particular, an air filter attachment, corresponding installation plates for the guide elements, and conduction and flow guiding plates for the air filter system are arranged. To achieve a spatial terminus to the outside, the above elements are frequently enclosed in their entirety by a plurality of removable plates, which are to protect the bracket and its attached and installed parts. This design of the bracket is costly to produce because of the many required individual parts and requires a lengthy and complex assembly.

Because tampers must very frequently be transported with heavy equipment during operation on the construction site, and in particular during unloading and loading procedures, the individual components are additionally subjected to strong mechanical stresses. In particular the connection bracket has proven in the known prior art to be the component in which these stresses have very frequently resulted in damage.

SUMMARY OF THE INVENTION

The present invention is therefore based on an object of providing a connection bracket and a tamping device having such a connection bracket, which, with more resistant and stable construction, is more cost-effective to produce and simpler to install.

The above object is thus achieved in one embodiment by a connection bracket for a tamping device, comprising a frame, a guide element mount, and a drive element mount, with the connection bracket having an air filter attachment integrally implemented therewith, such as an air filter socket. One aspect of the present invention is therefore to provide a multifunctional component which simultaneously unifies multiple essential functions therein.

A "tamping device" is understood in the scope of the present invention as any device which can be used via a tamping unit, and in particular a compaction unit, in particular for soil compaction. Inter alia, a tamping device is understood in the scope of the present invention as a vibration compactor and a rammer, respectively, in which, via the drive element, a vibration damper, in particular a tamping base of a vibration tamper, is driven to oscillate. Such a vibration tamper typically comprises a substructure having a compaction or tamping plate and a superstructure having an internal combustion engine having an air filter unit, a fuel tank, and a guide bow. The internal combustion engine drives a tamping movement of the tamping plate in a way known per se via a crank mechanism.

According to one embodiment of the present invention, the connection bracket has a guide unit implemented integrally therewith for combustion air, comprising in one embodiment an air filter attachment such as an air filter socket. A guide unit for combustion air refers in general to an area and/or a unit of the connection bracket, which conducts the combustion air in the context of the intake procedure of combustion air from the outside environment in a fixed direction. This can relate to the conduction of the air from outside environment up to the internal combustion engine or in particular only a part thereof. "Integral" means, in the scope of the present invention, the integral implementation of at least a substantial component and in particular the guide unit for combustion air together with the connection bracket, in particular with at least one wall thereof. The connection bracket is therefore implemented solidly with the guide unit for combustion air. In one embodiment, the connection bracket has, for example, an air filter attachment implemented in one piece therewith, such as an air filter attachment implemented as an air filter socket. Air filter attachment refers in general to a unit which is used for attaching an air filter, such as an air filter for combustion air. In the present case, combustion air refers to the air used by the internal combustion engine in the combustion process, with the air flow through the air filter preferably being induced by the intake procedure of the internal combustion engine.

In one embodiment, the connection bracket also comprises a guide element mount implemented in one piece therewith. The guide element mount is used for attaching at least one guide element and in particular a guide bow, via which the tamping device can be steered or operated, inter alia. In addition, the transport of the tamping device by means of a crane or a similar lifting unit is preferably possible via the guide element. Furthermore, suitable damping means can be provided for the direct linkage of the guide element to the connection bracket, which reduce the relay of vibrations from the connection bracket to the guide element. The connection points of the damping means to the connection bracket also fall under the term guide element mount.

The drive element mount allows the attachment of at least one drive element to the connection bracket, in particular an internal combustion engine, which has suitable transmission elements and is operationally linked to the compaction unit. The drive element usually comprises an combustion engine and a tamping gear with a tamping gear housing. The drive element mount of the connection bracket is implemented, in other words, in such a manner that it allows an installation of the connection bracket on the drive element, directly or indirectly. The function of the drive element is to drive the tamping or compaction unit provided on the tamping device. The drive element mount is also implemented integrally with the connection bracket. The connection bracket therefore forms the structural connection element between the guide element and the drive element of the tamping device.

"Integrally," as understood in the context of the present invention, means that the connection bracket is a substantially homogeneous component, in which the frame, the guide element mount, the drive element mount, and the guide unit for combustion air are implemented as a common and continuous component, essentially in one piece. Integrally means in particular that the connection bracket cannot be disassembled into the individual units "frame", "drive element mount", "guide unit for combustion air", and "guide element mount". Therefore, separate connection means, such as screws, weld seams, adhesive layers, etc., are also not provided, which are joined together successively in the assembly process and hold together the individual units. Rather, the connection bracket is a substantially unified component of the tamper, on which the frame, the guide element mount, the drive element mount, and the guide unit for combustion air are implemented simultaneously. It is obvious that suitable connection means, for example, screw connections, can be used to attach the connection bracket to the drive element and to the guide element in the area of the drive element mount and in the area of the guide element mount. However, this does not contradict the integral implementation according to the present invention of the drive mount and the guide element mount on the connection bracket. According to one aspect, the corresponding mounting units on the connection bracket side for the guide unit and the drive unit, such as boreholes, are implemented integrally in the overall unit of the connection bracket together with the frame and the guide unit for combustion air, in particular an air filter attachment.

The present invention therefore also provides that the connection bracket is implemented so that it is used not only for the coupling between drive element and guide element by the provision of suitable mounts, but rather simultaneously also has an integrated guide unit for combustion air. The guide unit for combustion air comprises at least one air filter attachment, such as an air filter socket, via which an air filter can be positioned on and/or attached to the connection bracket. The air filter attachment is therefore part of an air filter system, via which environmental or combustion air can be filtered and supplied to the drive element and in particular the internal combustion engine. The air filter attachment is specifically implemented in such a manner that combustion air is conducted through it and filtered. Through the combination of integral attachment element (guide unit for combustion air, in particular air filter attachment) for the air filter system of the tamping device and installation element for installing the drive element or elements and the guide element or elements, substantially more efficient production and assembly of the tamping device are achieved. Because of the integral implementation, a connection bracket is additionally obtained having very high stability and resilience. In addition, the production and maintenance process can be substantially simplified by the integral embodiment of at least substantial parts of the air filter system on the bracket.

According to one aspect of the present invention, the connection bracket is an essentially one-pieced separate component of the tamping device that has a triple function. In addition to its function as an attachment element for the guide element, for example a guide bow, the connection bracket functions as the attachment element for the drive element, that may especially comprise an combustion engine and a crank gear driven by the combustion engine, and, furthermore, it functions as an air guidance element that guides combustion air. Especially, if the connection bracket is made of plastics, a very efficient heat decoupling arrangement to avoid heat transfer from the combustion engine or from a gear housing of the drive element to the combustion air and/or the air filter is achieved, besides the advantages as described above. A key feature of the present invention according to one embodiment is thus the partition of the construction elements of the tamping device between the drive element and the connection bracket and additionally with the construction of the connection bracket using plastics.

The specific implementation of the air filter attachment can be varied in various ways. However, it has fundamentally proven to be advantageous to implement the air filter attachment in such a manner that it has suitable receptacle elements to make the exact positioning of one or more air filter elements easier. In particular, the implementation of the air filter attachment in the form of an air filter socket has proven to be particularly suitable. The air filter socket is implemented in the form of a hollow cylinder in particular and is dimensioned in such a manner that, for example, a commercially available ring air filter can be slipped over it. The air filter socket protrudes in relation to the areas of the connection bracket adjoining it. Such an air filter socket has the advantage that, on the one hand, it is comparatively simple to implement in design and, on the other hand, it simultaneously allows very reliable stable positioning of the air filter.

Furthermore, another feature of the connection bracket of the tamping device is the frame. Frame refers in general to an element which connects, and in particular also supports, the guide element mount and the drive element mount. The frame of the connection bracket is preferably implemented in such a manner that it at least partially delimits a receptacle space, in which the guide unit for combustion air, which is implemented integrally with the connection bracket, and in particular the integral air filter attachment is arranged. In a further embodiment, the frame is implemented so that it forms a substantial part of an air filter housing, in particular comprising a closed receptacle space, which is only open on one side, in particular the top side of the connection bracket. The receptacle space at least partially formed by the frame is therefore sufficiently large here to also accommodate at least one air filter. Depending on the embodiment, the frame of the connection bracket can also be implemented as sufficiently large that further filter elements, as specified in greater detail hereafter, find space in the receptacle space. Both embodiments result in a tamping device or a connection bracket having particularly small component dimensions. The connection bracket simultaneously additionally assumes the function of forming an enclosure which is at least partially open, in particular toward only one side, for the air filter attachment up to a substantial part of an air filter housing. This combination of the functional and static functions in a single component results in a cost savings and a simplification of assembly to a particular extent.

The frame of the connection bracket is implemented in one embodiment so that the receptacle space at least partially enclosed thereby is closable using a cover, in particular using a plastic cover. The receptacle space, in which preferably at least one air filter is attachable on the air filter attachment, is therefore very easily accessible through this cover, which makes the replacement and the maintenance of the air filter system easier in particular. In addition, in certain embodiments, the cover provides an additional contribution to the resilience of the connection bracket. In this embodiment, the receptacle space is therefore closed to the outside by the frame and the cover, so that the frame and the cover form the air filter housing in its entirety. Alternatively or additionally, the frame can also be implemented in such a way that it has essential elements for guiding the air through the connection bracket.

In order to protect the connection bracket from damage, the frame preferably has at least one protective wall. The protective wall can be implemented in relation to the cover in such a manner that, in the case of closed receptacle space of the frame, it laterally adjoins the cover at least in a subsection and in particular has a free front side edge extending at least partially in the same plane with the cover or protruding beyond the cover. This protective wall, which is preferably implemented integrally with a horizontally extending base plate of the connection bracket or the frame, substantially increases the resilience of the connection bracket. In this way, it is additionally possible to produce the cover with low material expenditure, the protective wall extending partially laterally to the cover absorbing mechanical stresses which act on the connection bracket. The protective wall is very particularly effective if it is implemented as double-walled, i.e., it comprises two walls spaced apart substantially parallel to one another and arranged located one behind the other. The two walls can additionally be connected to one another via interposed connection walls, whereby the carrying capacity of the protective wall can be increased still further.

The protective wall is preferably arranged on the side of the connection bracket facing toward the front side of the tamper (viewed in the main operating direction of the tamper). This implementation has proven to be particularly advantageous. If the guide element mounts of the tamping device are additionally arranged on the side walls extending orthogonally to the protective wall, the guide bow then preferably essentially enclosing the connection bracket on three sides, namely along the side walls and the protective wall, a tamping device results which is protected much better against mechanical damage than in the prior art.

The cover can fundamentally be implemented as a substantially flat element which covers the receptacle space. The cover preferably comprises upright walls extending into the receptacle space, however, which extend from an upper, substantially flat cover element down to the base plate of the connection bracket. In this embodiment, the cover having its upright walls stands on the base plate of the connection bracket and furthermore preferably does not rest on the upper edge area of the receptacle space. Therefore, on the one hand, the receptacle space is divided into an inner space enclosed by the upright walls, the base plate, and the cover, and an outer or entrance space located outside the upright walls, whereby in particular a multistage air purification to be described in greater detail hereafter is made possible within the receptacle space. On the other hand, because the cover does not rest peripherally on the upper edge area of the receptacle space, at least not completely, an air entry gap is obtained, via which the ambient air can flow or be suctioned into the receptacle space. Therefore, separate air entry elements are dispensable. In order to allow efficient air guiding inside the divided receptacle space, it is important that the combustion air flows in a targeted manner into the receptacle space and subsequently does not arbitrarily flow from the space located outside the upright walls into the space located inside the upright walls. The upright walls of the cover are therefore ideally implemented as sealed in the area of the base plate. For this purpose, separate seal elements can fundamentally be used, the implementation of a labyrinth seal between the cover and in particular its upright walls and the frame having proven to be particularly advantageous, the elements of the labyrinth seal which form a seal against one another ideally being implemented in one piece with the cover and in particular the upright walls and the base plate. The cover having its upright walls therefore rests solely mechanically on the base plate, whereby a seal sufficient for practical use is already obtained. Additional separate sealing elements can simultaneously be dispensed with. The implementation of the cover having upright walls resting on the base plate of the connection bracket can also be used for clamping a filter element, the advantage of a defined clamping situation resulting here, because the upright walls delimit the extent of the filter element fixing.

The connection bracket, and in particular the frame, preferably has a rib structure. The rib structure is distinguished in that it comprises at least one rib, which stands out from or protrudes from the environment adjoining it. A rib can therefore in particular be a material bulge or a material thickening. The at least one rib can also be implemented in the form of a connection wall, however. In this embodiment, the rib therefore connects two areas of the connection bracket and in particular the frame to one another. A substantial increase in stability can be achieved by the presence of the rib structure, so that the connection bracket has a particularly high carrying capacity.

In one embodiment, the rib structure comprises a plurality of honeycomb walls connected to one another. A honeycomb wall is generally part of at least one honeycomb, a honeycomb being characterized in the present case by the presence of at least three honeycomb walls. A honeycomb therefore represents a cavity which is not necessarily terminated on all sides, and which is at least partially delimited to the outside by the corresponding honeycomb walls. It is obvious that the individual honeycomb walls do not necessarily have to be implemented as flat, but rather can certainly also be curved or three-dimensionally deformed in another manner. However, it is advantageous in regard to the desired increase in stability for the at least one honeycomb wall of a honeycomb to be implemented as essentially flat.

The rib structure allows a light construction, which ensures a high carrying capacity in spite of extremely low material expenditure. Because, in addition, the overall structure of the connection bracket is very much stiffer, the service life of the connection bracket or the tamping device equipped therewith is substantially increased. In particular during the strong alternating loads which act on the connection bracket during the operation of the tamping device, the rib structure of the connection bracket has proven to be very advantageous. The rib structure can vary greatly in its specific implementation and is substantially dependent on the specific implementation of the connection bracket. However, it is preferred in one embodiment that sealing points or sealing lines, for example, in the labyrinth seal, are spaced apart from the rib structure.

Furthermore, in addition to the air filter attachment, the connection bracket according to one embodiment of the present invention can comprise components of an air filter system implemented integrally therewith, for example, an intake line and/or an intake line attachment, in particular from the connection bracket to the internal combustion engine. It is therefore possible to provide a connection bracket in which the air filter system is implemented integrally in substantial parts and is integrated in the connection bracket.

Although it is preferable to ensure the air supply from the external environment into the receptacle space of the connection bracket in the above-described manner with the aid of an air entry gap between the cover and the frame, the connection bracket can additionally or alternatively comprise a separate air inlet opening, which is implemented in such a manner that air from the outside, i.e., air which externally encloses the connection bracket in the installed state, can flow through the at least one air inlet opening to the air filter attachment. In other words, the air inlet opening allows a passage of the external environment air through the connection bracket into the receptacle space, which is at least partially enclosed by the connection bracket. This means that optionally not only the flow channels for the air which is blown in or out can be implemented in the connection bracket, but rather simultaneously also corresponding inlet and outlet openings. A very complex bracket is thus obtained, which nonetheless takes over a plurality of functions with cost-effective production.

The connection bracket is preferably implemented in one embodiment in such a manner that it represents an essential element for partitioning an intake area from an emission area. The intake area is distinguished in that outside air enclosing the tamping device is sucked in. The emission area, in contrast, is the area in which the connection bracket discharges air, in particular filtered air. This separation is achieved in the design, for example, using a base plate comprised by the connection bracket. In the intake area, the air flows to the air filter attachment, in particular the air filter socket. Air which flows therefrom via the air filter through the fluid opening into the base plate is supplied in the emission area via a corresponding flow guide to the drive element and in particular to an internal combustion engine. The base plate is preferably also used both for the flow guiding and also the static stiffening of the connection bracket.

The air filter attachment of the connection bracket is preferably part of a double air filter system. A double air filter system is generally distinguished in that the air flows through two filter stages successively. Therefore, for example, a fine purification for separating smaller particles can follow a first, coarse purification of the intake air for separating large particles. The advantages of such a double air filter system are, for example, lengthened maintenance intervals, improved filter performance, etc. The first filter stage is integrated in the connection bracket via the air filter attachment implemented in the connection bracket. It is possible in regard to the additional filter stage to implement it as detached from the connection bracket as an independent component. However, the additional filter stage may also at least partially integrated in the connection bracket. In particular the integration of attachments for the additional filter stage in the connection bracket has proven to be particularly practical. Alternatively or additionally, it is also possible to provide means for relaying the air from the additional filter stage to the filter attached to the air filter attachment. These means for relaying therefore connect the two air filter systems to one another in regard to flow. The additional filter stage is specifically a cyclone filter in particular, which is preferably removably fastened via corresponding connection elements on the connection bracket, in particular in the receptacle space of the connection bracket. On the one hand, this has the advantage that the compact embodiment of the connection bracket is maintained. On the other hand, the cyclone filter can be replaced separately.

It is also conceivable to implement a separation space for the part of an air filter system implemented as a cyclone filter system in the connection bracket, in particular in the receptacle space, in addition to the air filter attachment. The separation space is distinguished in that coarse particles filtered out by the cyclone filter are collected therein. The separation space can comprise a suitable particle trough for this purpose, for example, or, preferably, can have a dust discharge opening, which allows the discharge of the collected particles from the interior of the receptacle space into the environment located outside the connection bracket. A self-cleaning function can thus be implemented.

Specifically, the connection bracket therefore particularly preferably has, in addition to the filter stage obtained via the filter attached to the air filter attachment, a coarse filter stage connected upstream with respect to flow, in particular in the form of a cyclone filter. In this embodiment, multiple filter stages are therefore arranged in series. In this manner, a multistage, in particular two-stage filter system is obtained overall, which allows particularly effective purification of particles from the combustion air.

It is ideal if the multiple filter stages are at least partially optionally usable. Specifically, for example, an embodiment has particularly proven itself in which the cyclone filter is optionally insertable into the connection bracket and therefore operation of the tamping device without the inserted cyclone filter is also possible. This allows the prior manufacturing of a standardized connection bracket and the optional adaptation if needed.

Preferably, a dirt guide unit or particle guide unit is additionally provided in the connection bracket in the inner space enclosed by the base plate, the cover, and the upright walls of the cover, via which in particular the dirt particles filtered out during the air filtering can be transported to the outer side of the connection bracket or the tamper. Such a dirt guide unit can be, for example, an opening in the base area and in particular in the lowest area of the connection bracket, so that the filtered-out dirt particles fall out downward and therefore out of the connection bracket during the vibration operation. Furthermore, this opening can be closed by a valve unit, in particular a diaphragm valve.

The connection bracket preferably substantially consists of plastic and in particular at least one plastic from the group of thermoplastics. Only because of the design according to one embodiment of the present invention of the connection bracket can the production methods from sheet metal or similar metals known from the prior art be intentionally dispensed with. In particular, the production of the connection bracket as an injection-molded component allows the cost-effective design in this case. This is the case in particular if the honeycomb walls of the rib structure are accordingly arranged optimized for injection molding. Substantially in this case means that in addition to the main material plastic, additional components of other materials can also be incorporated into the connection bracket. These can particularly be metal inserts, which are preferably arranged in connection areas, for example, in order to avoid occurrences of settling in the plastic in the area of the connection points of the connection bracket to the guide element and/or to the drive element. The connection bracket in particular substantially consists of plastic if the non-plastic fraction of the connection bracket is less than 10 and very particularly less than 5 weight-percent in relation to the total weight of the integral connection bracket. The use of plastics has the further advantage that the decoupling of the heat transfer between the drive element, especially a gear housing of the drive element, and the guide elements for combustion air of the connection bracket, especially the air-intake area and/or the air filter area is optimized.

The present invention therefore not only comprises a connection bracket according to the above-described type, but rather also an injection mold using which such a connection bracket can be produced.

Through the implementation of the connection bracket from a plastic material, in particular in conjunction with the rib construction, a very durable connection bracket is obtained, which is also suitable for stronger stresses because of its elasticity. In addition, the resulting elastic embodiment of the connection bracket improves the guide behavior of the tamping device, since vibrations from the compaction unit and the drive unit are only still transmitted in damped form to the guide bow arranged on the connection bracket. This effect can be enhanced still further by the additional use of special damping elements, of course.

It is possible to implement corresponding bearing receptacles for the guide element mount and/or drive element mount integrally on the connection bracket. For example, corresponding rubber cushion receptacles can be provided for damping rubber cushions for attaching the guide element, etc.

Through the integral implementation of the connection bracket with guide element mount, drive element mount, and guide unit for combustion air, in particular air filter attachment, a component is obtained which is very easy to clean through suitable wall guiding. The implementation of at least one drain opening in a low-lying area of the connection bracket is very particularly possible, so that existing contaminants are either discharged during the vibration operation or can float out or be removed during cleaning. Using this preferred embodiment, it is therefore possible that the connection bracket has a self-cleaning function in such a manner that particles separated by the at least one air filter are collected in the connection bracket and guided out of the connection bracket via the at least one outlet opening.

The present invention additionally relates to a method for assembling a tamping device of the above-described type, through the use of a connection bracket as described above, the guide element mount, the drive element mount, and the guide unit for combustion air, in particular the air filter attachment, being positioned simultaneously with the installation of the connection bracket. Through the integral implementation of these mounts or attachments in the connection bracket, the assembly steps of the tamping device are reduced by a multiple.

BRIEF DESCRIPTION OF THE DRAWINGS

The present invention is described hereafter on the basis of an exemplary embodiment, which is described in greater detail by the appended drawings. In the schematic figures.

DETAILED DESCRIPTION

Figure 1:
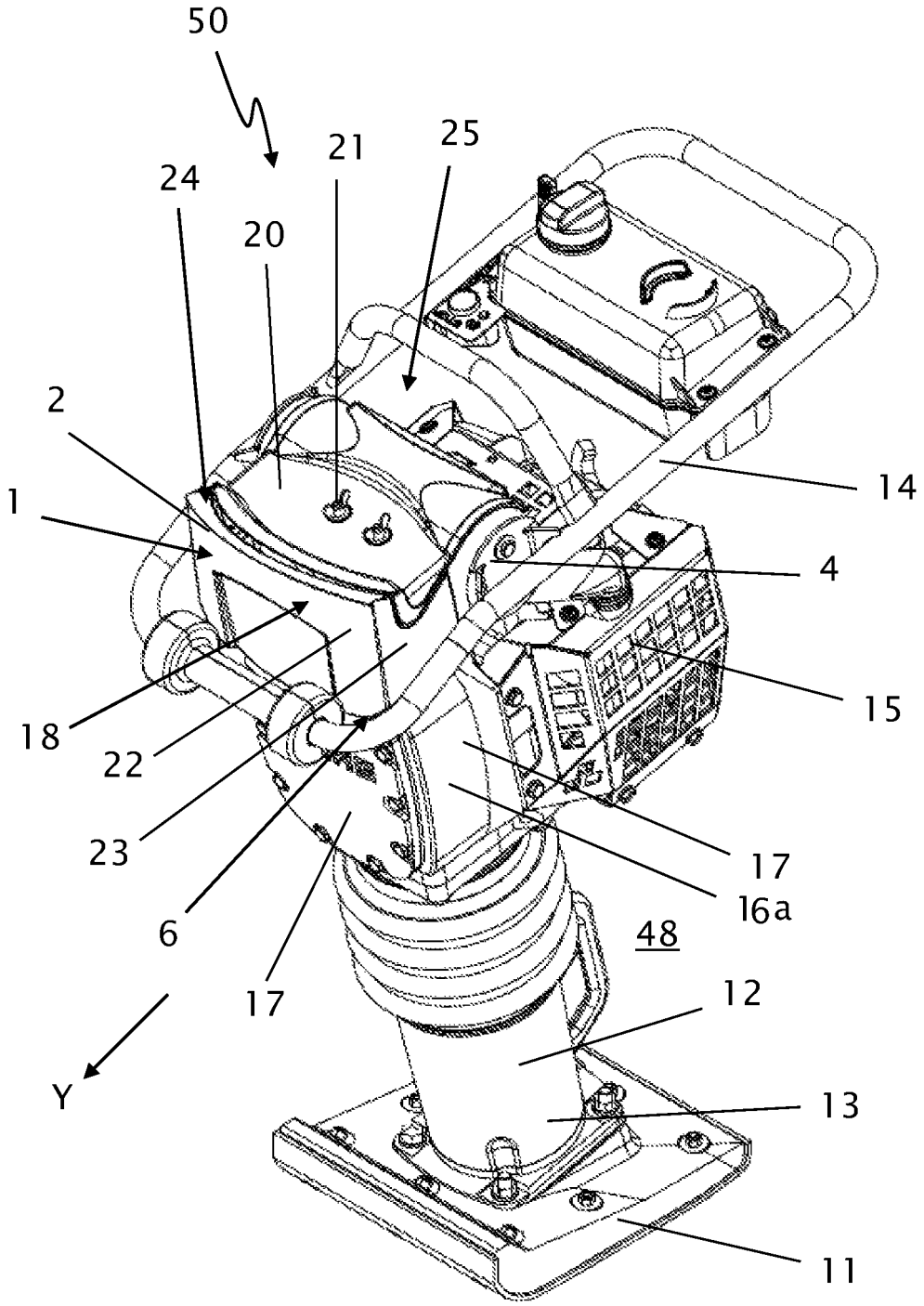
FIG. 1 shows an isometric view of an embodiment of the tamping device according to the present invention.

The same reference numerals are used hereafter for identical and identically acting components, apostrophes sometimes being used for differentiation.

FIG. 1 shows an isometric view of an embodiment of the tamper 50 according to one embodiment of the present invention. The tamper 50 is a vibration compactor for compacting soil. As the central component, it comprises a connection bracket 1, to which a drive element 16 and a guide element 14 are attached.

The drive element 16 comprises an internal combustion engine 15 and a transmission element 17, via which a compaction unit 12, and in this case a tamping base 13 having a compaction plate 11, can alternately be driven. Via the internal combustion engine 15, in this manner a compaction amplitude can be generated, which introduces alternating compaction pulses into the substrate via the compaction plate 11. The transmission element 17 comprises a gear housing 17*a* and the connection bracket 1 is connected with its underside to a part of the upper side of the gear housing 17*a* with connecting elements, for example screw connections, that are not visible in FIG. 1.

The guide element 14 is implemented in this embodiment as a guide bow, which is attached directly to the connection bracket 1. It allows in particular the steering of the tamper 50 in tamping operation. Furthermore, an operating console (not shown in greater detail) is arranged on the guide bow 14, via which control functions for the tamping operation can be regulated.

As also shown in detail in the following figures, the solid and essentially one-pieced connection bracket 1 has a frame 2, a guide element mount 4, and a drive element mount 6, so that the guide element 14 and the drive element 16 are directly operationally linked to the connection bracket 1. In other words, the guide element 14 and the drive element 16 are connected to one another via the connection bracket 1 and are implemented integrally therewith. In contrast to tampers known from the prior art, through this implementation of the connection bracket 1, the production and assembly effort is reduced immensely.

Figure 2:
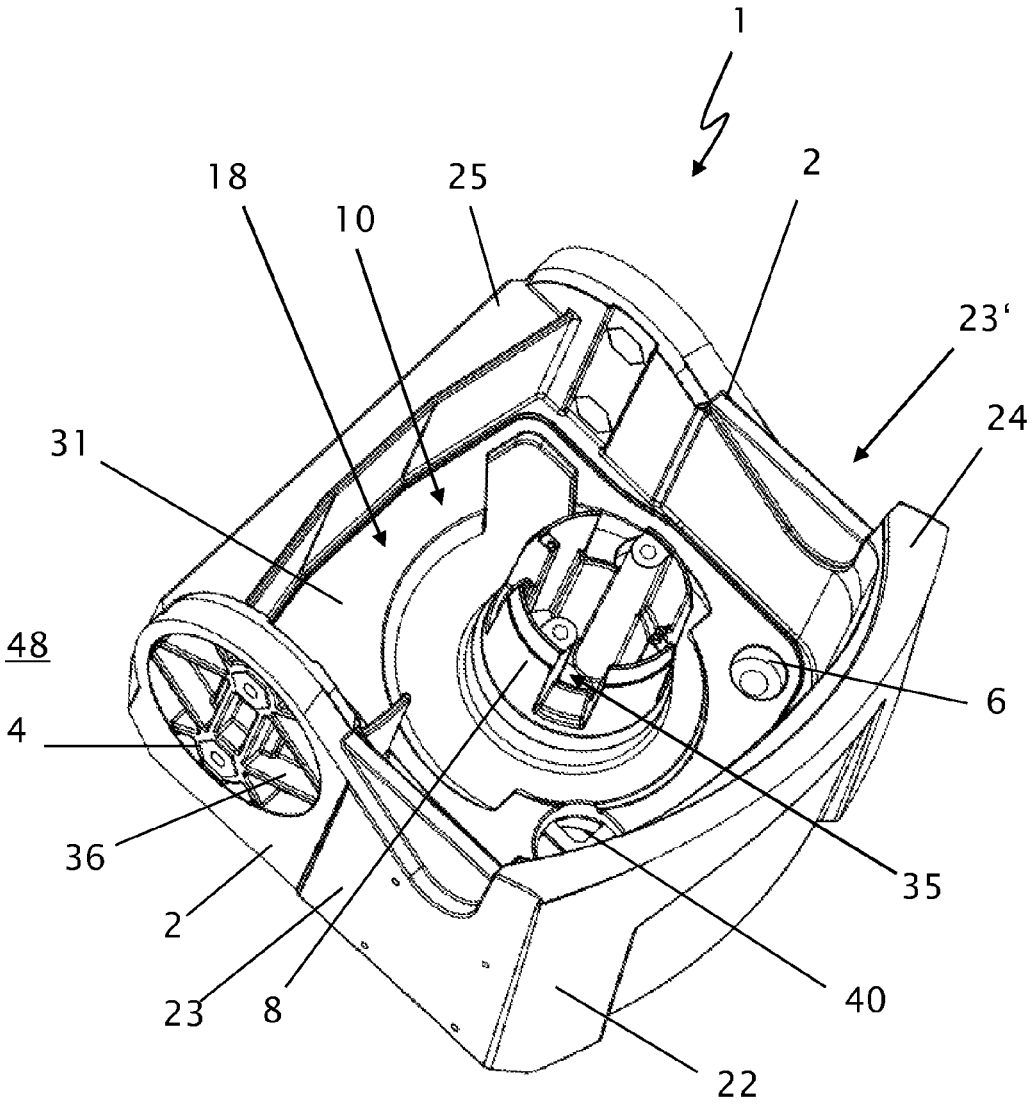
FIG. 2 shows an isometric view of an embodiment of a connection bracket of the tamping device from FIG. 1 diagonally from above.
Figure 3:
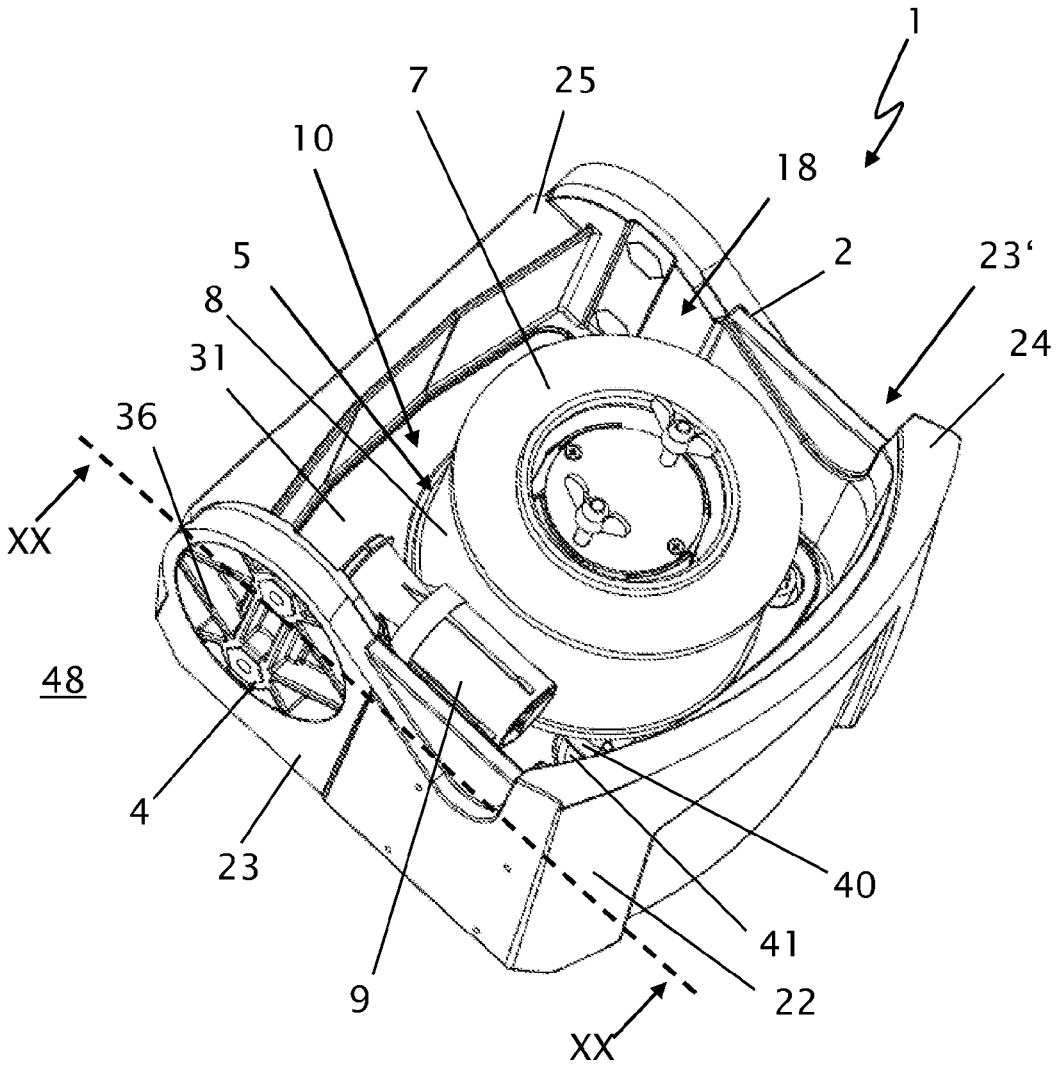
FIG. 3 shows an isometric view of the embodiment of the connection bracket according to FIG. 2 having inserted air filter.
Figure 4:
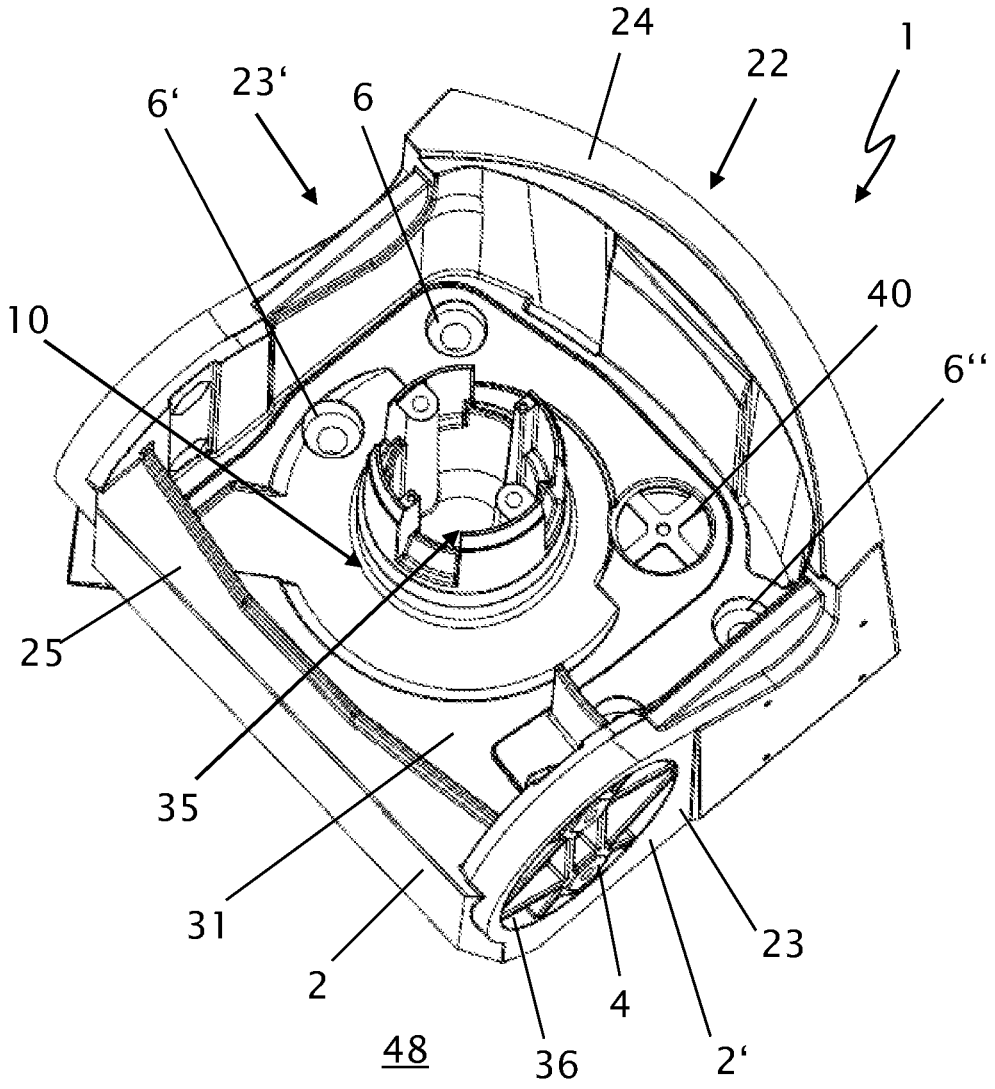
FIG. 4 shows an isometric view of the embodiment of the connection bracket from FIG. 2 from another viewing angle.
Figure 5:
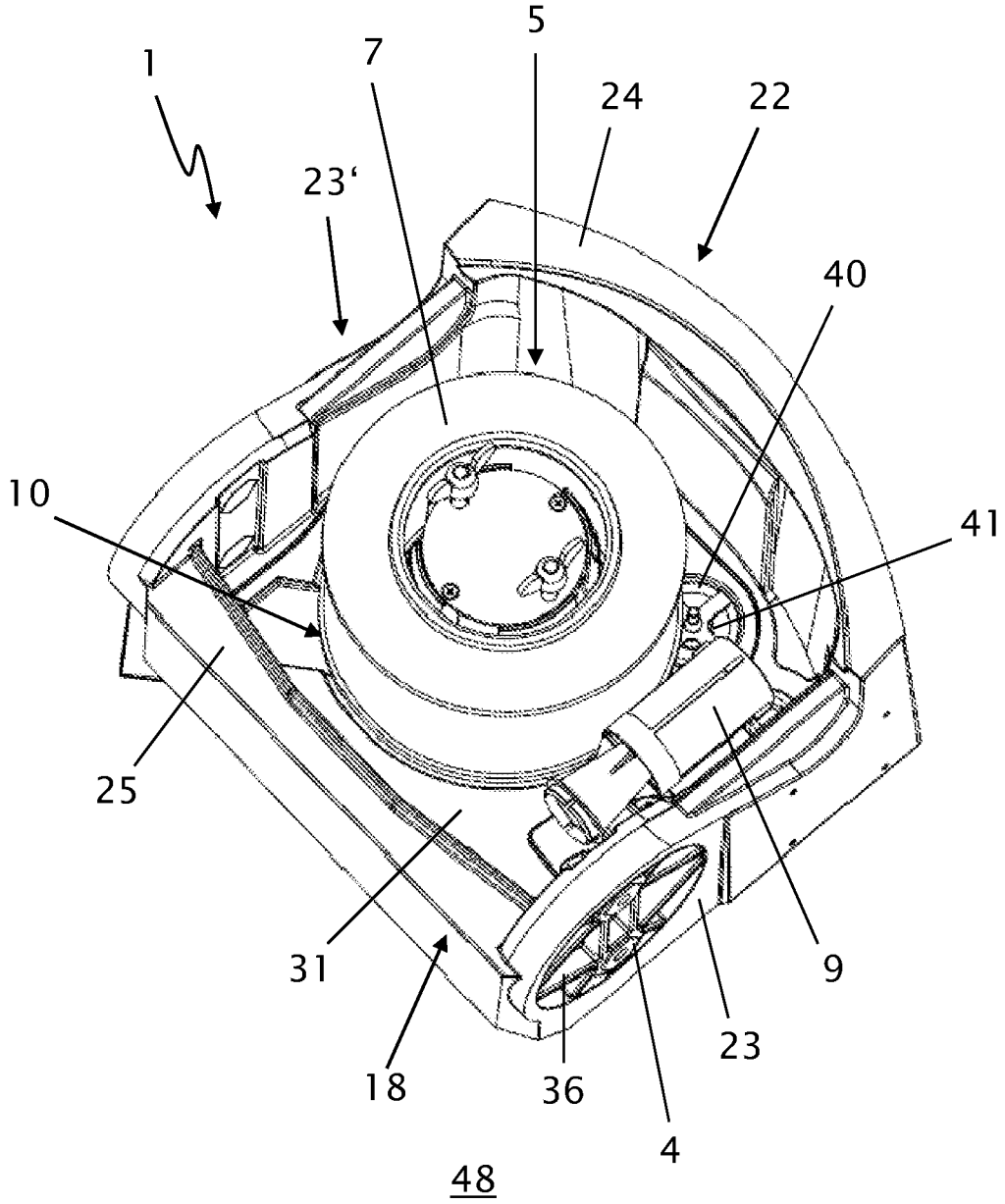
FIG. 5 shows an isometric view of the embodiment of the connection bracket according to FIG. 4 having inserted air filter.

The connection bracket 1, especially its frame 2, has, in the direction of the main operating direction Y of the tamper 50, a protective wall 22, which adjoins side walls 23 on both sides. Together with a rear wall 25, these walls 22, 23, 25 form a receptacle space 10 (see FIGS. 2 and 3 in particular), in which an air filter attachment 8 for accommodating an air filter 7 (round filter) in particular is provided. The connection bracket 1 is thus also implemented as an air filter housing 18.

The connection bracket 1 is accordingly not only a connection element between the drive element 16 and the guide element 14, but rather simultaneously also an essential component of an air filter system, described in greater detail hereafter, of the tamper 50. The access to the air filter attachment 8 (see in particular FIGS. 2 and 3) is ensured via a cover 20, which can be screwed against the connection bracket 1 via connection elements such as screws 21 (see FIG. 1). Together with the cover 21, the connection bracket 1 encloses the air filter 7 nearly completely.

As shown, the protective wall 22 forms, in conjunction with the side walls 23, a wall protruding vertically from the base plane of the connection bracket 1, which forms a special safeguard for the connection bracket 1, the cover 20, and the air filter system accommodated therein to the front and to the sides, in particular during the loading operation of the tamper 50. The protective wall 22 is specifically implemented as double-walled and comprises the two individual walls 22*a* and 22*b* (for example, FIG. 13), which are arranged located one behind the other and extending substantially parallel to one another. As described in greater detail hereafter, the walls 22, 23, and 25 of the frame 2 and the base plate of the connection bracket 1 are reinforced with the aid of a honeycomb structure, which provides the connection bracket 1 with a special resilience with simultaneous elastic behavior. Thus, in particular, multiple connection walls 22*c* (for example, FIG. 12) are also provided between the two individual walls 22*a* and 22*b* of the protective wall 22, which connect the two individual walls 22*a* and 22*b* to one another and in this manner especially also provide a honeycomb structure for structural reinforcement in this area. The connection bracket 1 thus formed can, with very light construction and cost-effective production, dissipate both the operating loads acting thereon, in particular during vibration operation, and also mechanical stresses during loading safely and without damage.

Figure 12:
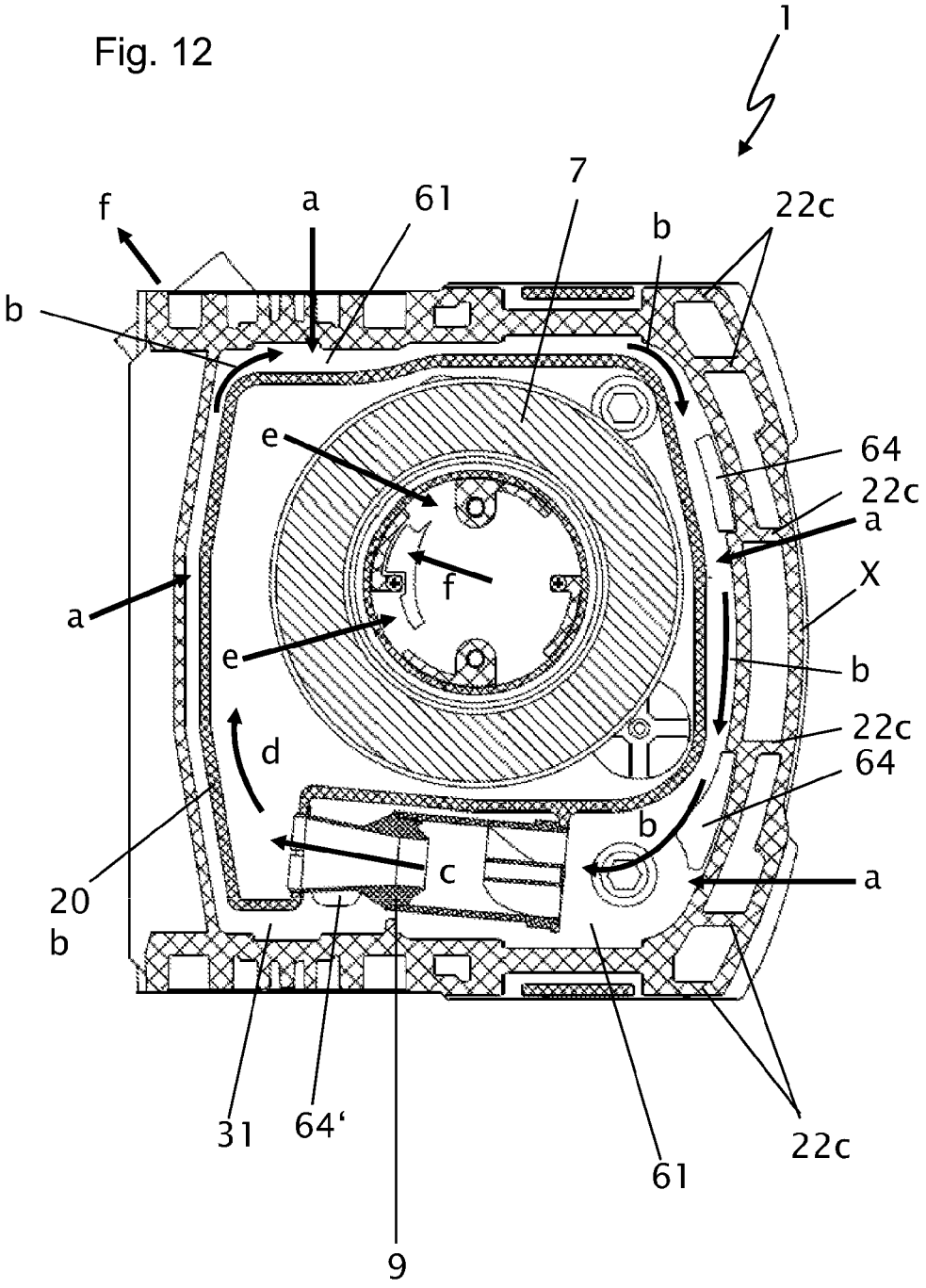
FIG. 12 shows a horizontal section through the connection bracket with put-on cover along line XX from FIG. 3.
Figure 13:
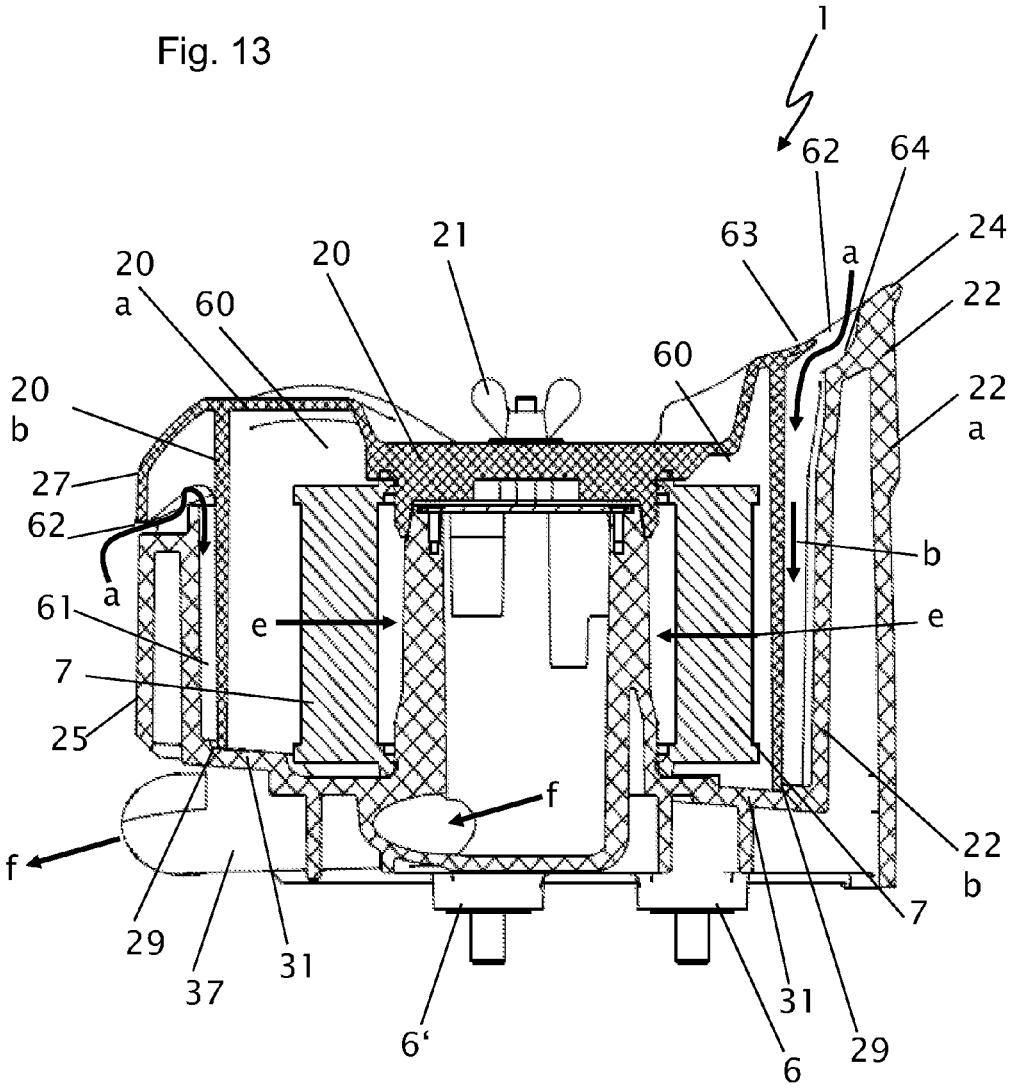
FIG. 13 shows a cross section through the connection bracket with put-on cover along line XXX from FIG. 11.

The connection bracket 1 depicted in FIG. 1 is shown in greater detail in FIGS. 2 to 13, with FIGS. 2, 4, 6, 8, and 9 showing the connection bracket from different perspectives and viewing angles without installed parts, while the connection bracket is shown in FIGS. 3, 5, 7, 10, and 11 from the perspectives and viewing angles with installed parts and in particular an air filter system. FIGS. 12 and 13 are sectional views through the connection bracket 1 with installed parts and cover 20, and illustrate in particular the mode of operation of the air filter system and the air guiding within the connection bracket 1.

In all of the figures, the connection bracket 1 is shown with its protective wall 22, the side walls 23 adjoining thereon, and the rear wall 25, which together form the frame 2. Furthermore, a base plate 31 is provided in the floor area, which forms, together with the walls 22, 23, and 25, a receptacle space 10 open to the top or to the top side of the connection bracket 1, which functions in the way described in greater detail hereafter as an air filter housing 18 having one or more air filters 7, 9 (see FIGS. 3, 5, 10, 11, and 12).

The receptacle space 10 is closed via the cover 20 shown in FIG. 1. In addition to a substantially planar cover plate 20*a*, the cover 20 also comprises upright walls 20*b* (FIGS. 12 and 13). The cover plate 20*a* and the upright walls 20*b* are also implemented in one piece and preferably also at least substantially consist of plastic. The upright walls 20*b* are oriented into the receptacle space 10 and extend from the bottom side of the cover plate 20*a* down to the base plate 31 in the state of the cover 20 inserted in the connection bracket 1. The cover rests on the surface of the base plate 31 with the frontal ends of the upright walls 20*b*. The upright walls 20*b* are implemented like a sleeve, similarly to a hollow cylinder, in their entirety and are implemented as closed in the surface except for a passage area (described in greater detail hereafter).

According to one aspect of the present embodiment, the cover 20 does not seal off the receptacle space 10 to form a seal on top or in the top edge area of the frame 2, but rather a sealing area is provided in the base plate 31. The cover 20 is therefore not seated on the edge of the frame 2, but rather is mounted via the upright walls 20*b*, which stand on the base plate 31, on the connection bracket 1. An entry gap 62, which is nearly peripheral to the upper edge of the frame 2, is provided between the cover 20 and in particular the cover plate 20*a* and the top outer edge of the frame 2, via which the air enters from the environment of the tamper into the receptacle space 10. The air guiding, and in particular the specific construction of the air filter system, will be described in greater detail hereafter.

Another aspect of the cover 20 is that it is dimensioned so that in the state inserted into the connection bracket 1 (FIGS. 1, 12, and 13), it does not protrude at least on the sides and the front side (area of the protective wall 22). In other words, the cover is free of protrusion in relation to the frame 2 on the sides and to the front or in the main operating direction Y. It is therefore ensured that the cover 20 is protected from damage and/or a location change in relation to the receptacle space 10 in the event of tipping over of the tamper 50 by the frame and in particular the protective wall 22, so that the functional integrity of the connection bracket 1 remains ensured even in the event of comparatively rough handling of the tamper 50.

According to FIG. 13, the cover 20 has, in its area oriented to the front or in the main operating direction, a lip 63, which extends diagonally upward away from the adjoining upright wall 20*b*. A channel 64 is provided nearly corresponding thereto but spaced apart in the normal state in the upper edge area of the protective wall 22. The lip 63 and the channel 64 together form a further protective unit, which counteracts damage of the cover 22. If the protective wall 22 is pressed in the direction of the cover 22, for example, in the event the tamper 50 falls over, from a specific deformation, the lip 63 runs into the channel 64, whereby a relief of the cover 22 is achieved overall and in this way irreversible damage to the cover 22 is avoided. The protective wall 22 of the frame 2 is also implemented as raised in relation to the lip 63 of the cover 20 (edge 24). The protective wall 22 therefore protrudes with the edge 24 upward beyond the cover 20, whereby a further safeguard of the cover 20 is obtained.

In the area of the rear wall 25, the cover has a projection 27, at which it overlaps the upper edge of the rear wall 25. However, the cover 20 is also not seated on the wall in this area, but rather is spaced apart from the rear wall 25, so that an entry gap 62 is also obtained here.

The connection bracket 1 is part of an air filter system, via which the sucked-in environmental air is purified and supplied to the internal combustion engine 15 shown in FIG. 1 for combustion operation. A division of the receptacle space 10 into an entrance space 61 and an inner space 60 is achieved by the upright walls 20*b* resting on the base plate 31, through which the sucked-in air flows successively. The inner space 60 is the area which, when the cover 20 is inserted in the connection bracket 1, is enclosed by a part of the cover plate 20*a*, the upright walls 20*b*, and a part of the base plate 31. In contrast, the entrance space 61 is the free space in the receptacle space 10, which is formed between the outer side of the upright walls 20*b* and the frame 2 inside the connection bracket 1. To allow targeted and reliable air guiding from the entrance space 61 into the inner space 60, it must first be ensured that the air flows in a controlled manner from the entrance space 61 into the inner space 60 in operation of the tamper 50. For this purpose, the entrance space 61 is sealed off in relation to the inner space 60. Specifically, the sealing is performed via a labyrinth seal 29 formed between the frontal area of the upright walls 20*b* oriented toward the base plate 31 and the base plate, for example, in FIG. 11, only the sealing edge of the labyrinth seal 29 located in the base plate 31 being indicated. The labyrinth seal 29 allows direct sealing of the upright walls 20*b* in relation to the base plate 31, so that additional sealing elements can be dispensed with.

The purification of the sucked-in air is preferably performed in two stages, with operation of the tamper also readily being possible using only one filter stage. For the purification, the unfiltered air sucked in from the environment of the connection bracket 1 first flows in via the entry gap 62 between the cover 20 and the frame 2 into the receptacle space 10 of the connection bracket 1. This is indicated in FIGS. 12 and 13 by the arrows a (the air not flowing through the connection bracket 1 in FIG. 12, but rather entering as shown in FIG. 13 via the entry gap 62 into the entrance space 61). Particularly coarse particles already settle on the corresponding area of the base plate 31 in the entrance space 61 and can be discharged from the entrance space via discharge holes 64 located in the base plate. For this purpose, the discharge holes 64 are arranged in the low point of the entrance space 61 in the base plate 31, which is located in the area of the base plate 31 adjoining the protective wall 22. The coarse particles therefore slip automatically to the discharge holes 64 in operation, so that a self-cleaning function is obtained. In addition, the entrance space 61 can easily be cleaned using water, which also automatically runs to the discharge holes 64.

The air is transferred from the entrance space 61 into the inner space 60 via a primary filter 9, specifically a cyclone filter. The air outlet of the primary filter 9 protrudes through a corresponding hole in the upright wall 20*b*. The air therefore flows after its entry according to arrow a into the entrance space 61 and within the entrance space 61 (according to the arrows b) to the primary filter 9. For the transfer into the inner space 60 through the hole in the upright wall 20*b*, the air flows through the primary filter (arrows c) and is subjected to coarse filtering. Filtered-out coarse particles fall out of the cyclone separator in a way known per se in the entrance space 61 and can be discharged from the connection bracket 1 via the special additional discharge hole 64' in the base plate 31 arranged below the primary filter 9.

Finally, a secondary filter 7 (specifically a ring filter) is arranged in the inner space 60, into which the air located in the inner space 60 flows according to arrows d. The air subsequently flows through the secondary filter 7 (arrows e; specifically inward in the radial direction) and is subjected to a further purification, fine particles being filtered out of the air and settling on the base plate 31 in the area of the inner space 60. A valve-controlled particle outlet 40 having a valve 41 which opens because of internal pressure changes is provided therein, via which the foreign particles can again leave the air filter housing 18 of the connection bracket 1. A self-cleaning function for independent particle discharge is therefore also provided in the area of the inner space 60.

After the passage of the secondary filter stage 7, the air, which is now purified of particles, is discharged via the inner space of the air filter attachment 8, which is connected to the suction line 37, according to arrow f out of the connection bracket 1 to the internal combustion engine. Corresponding passage openings are provided in the air filter attachment 8 implemented as an air filter socket for this purpose. The combustion air, which is suctioned out of the environment of the connection bracket 1 and filtered in the air filters 7, 9, therefore penetrates the base plate 31 via an air guiding passage 35, which guides the filtered air to an air outlet opening 38 via a suction line 37 (see in particular FIGS. 6 and 7). An intake connecting piece or similar component of the drive unit 16 and in particular of the internal combustion engine 15, which then supplies the supplied filtered air to combustion operation (not shown), engages in the area of this air outlet opening 38.

The air therefore successively passes a total of two filter stages up to the outlet from the receptacle space 10, first a primary air filter 9 and subsequently a secondary air filter 7. Overall, the connection bracket 1 therefore has a double air filter system. The two filter stages 7 and 9 are each used to separate particles out of the air, to be able to supply combustion air which is as particle-free as possible to the internal combustion engine.

A further aspect of the present design is also that the primary filter stage 9 is removably attached to the connection bracket 1. A connection unit (not shown in greater detail) is provided for this purpose. Fundamentally, operation of tamper 50 is therefore also possible even without the inserted primary filter stage because sufficient air filtering is still being obtained via the secondary filter 7. Depending on the field of use and/or equipment of the tamper 50, the operator can therefore decide whether he operates the tamper 50 with or without the inserted primary filter stage 9.

The secondary filter stage 7 is also implemented as replaceable. For this purpose, the cover 20 must be removed from the connection bracket 1, so that the secondary filter stage 7 is accessible. A further aspect of the present specific embodiment of the present invention is that the retaining of the secondary filter stage 7 is substantially achieved via the cover 20 clamped in the connection bracket 1, which therefore also fulfills a double function in this regard. The ring filter (secondary filter 7) is clamped and fixed in location in the axial direction for this purpose between the base plate 31 and the cover 20. For this purpose, the frontal inner edges of the ring filter press against the cover 20 and against the base plate 31 on the opposite side. The cover 20 is screwed onto the air filter attachment 8 implemented as an air filter socket (for example, according to FIG. 13). A defined spacing is thus achieved between the inner side of the cover 20 and the inner side of the base plate 31 facing toward the cover 20, so that defined clamping of the ring filter is ensured. Lateral slipping of the ring filter is prevented, on the one hand, by the cover 20 which also partially engages in the ring filter and, on the other hand, by the base area of the air filter socket protruding into the ring filter.

The suction line 37 for discharging the purified combustion air out of the connection bracket 1 to the internal combustion engine is also implemented at least partially integrally with the connection bracket 1. The connection bracket is therefore provided as a whole with further functions, whereby the manufacturing process can be streamlined once again. The main advantage of implementing the suction line 37 integrally with the connection bracket 1 is that the heat transfer from the drive element 16, especially its gear housing, is minimized in the area of the drive element mount such that the intake air is not heated in this area.

Figure 6:
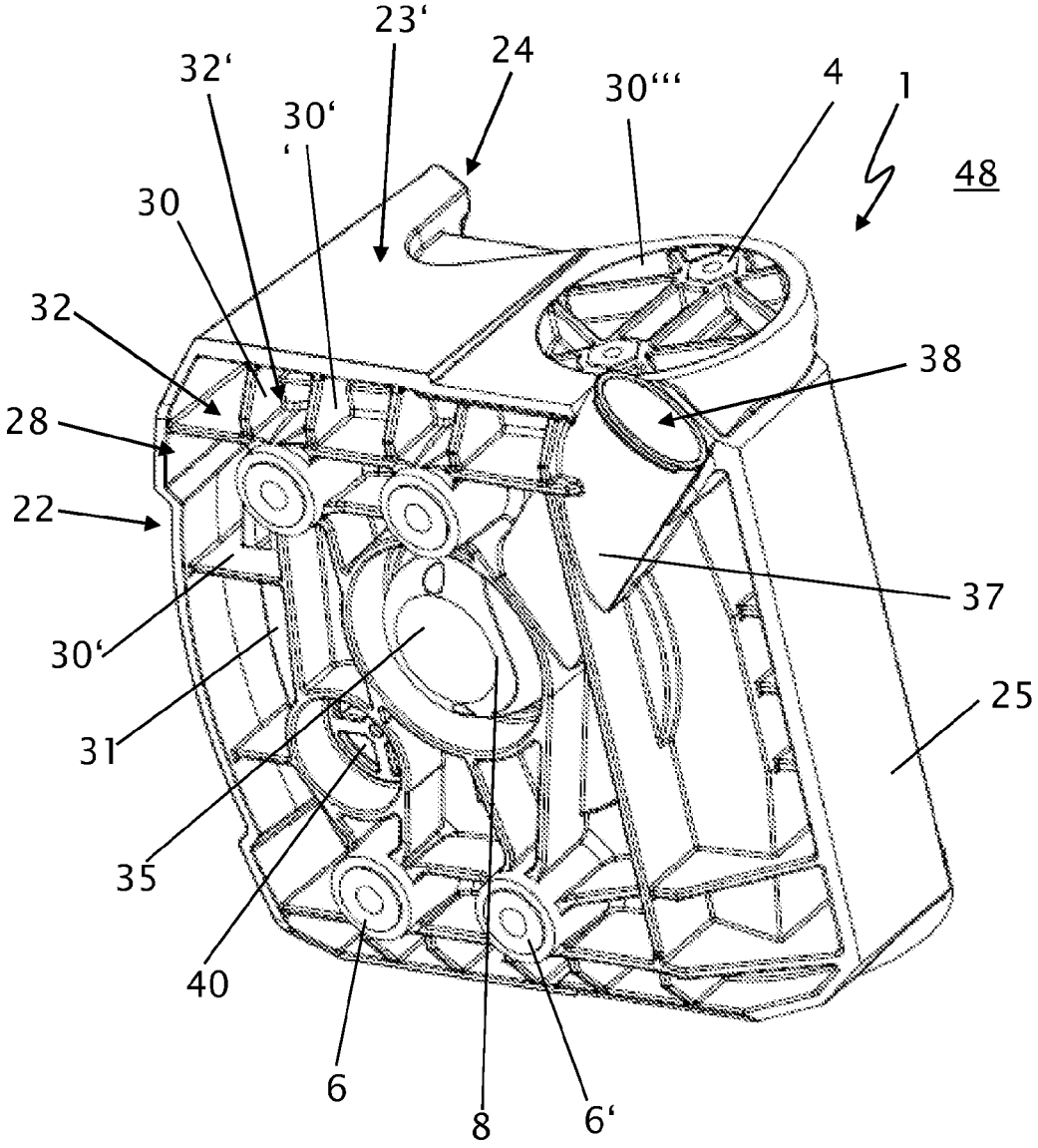
FIG. 6 shows an isometric view of the embodiment of the connection bracket according to FIG. 2 diagonally from below.
Figure 7:
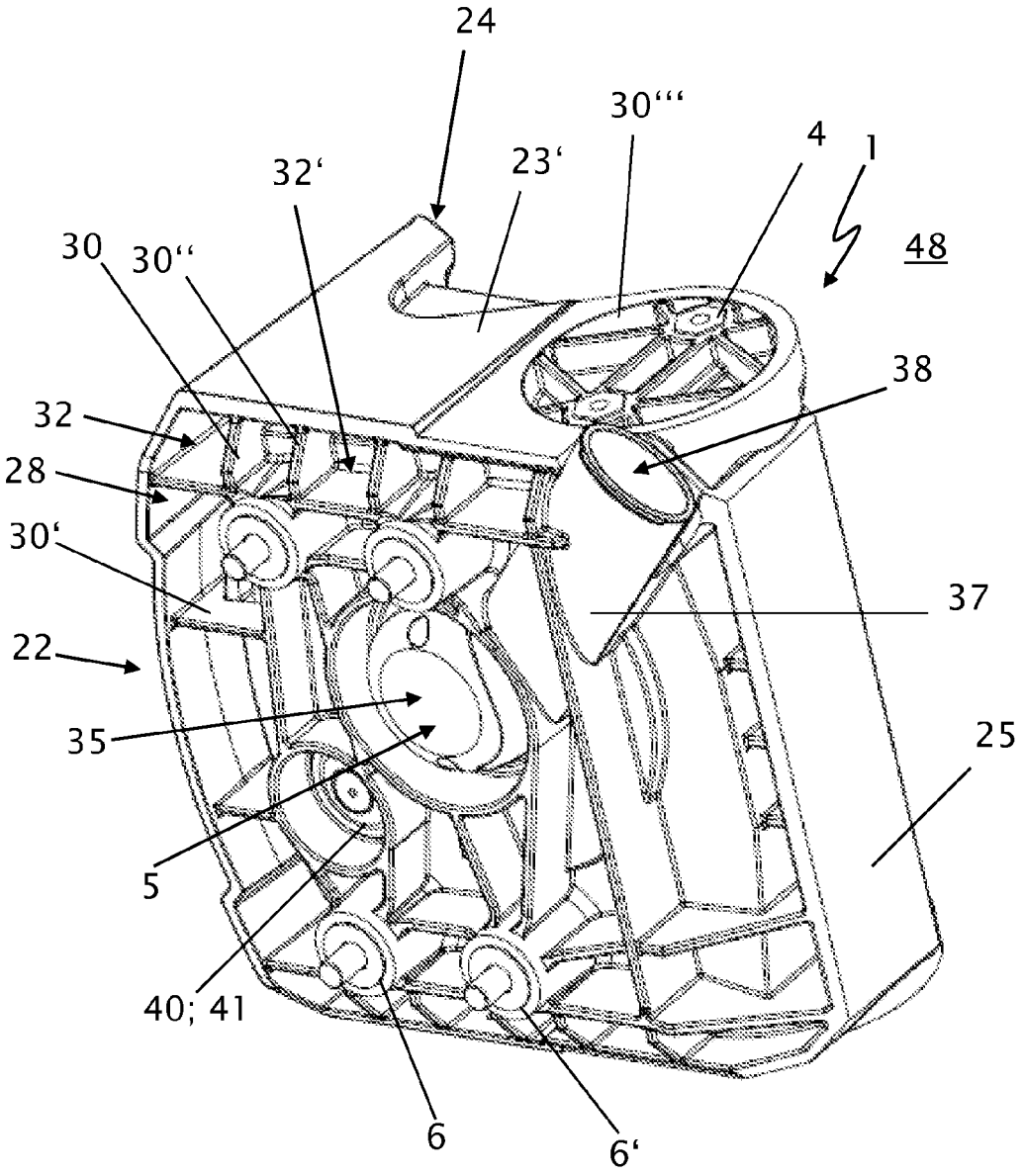
FIG. 7 shows an isometric view of the embodiment of the connection bracket according to FIG. 6 having inserted air filter system.
Figure 8:
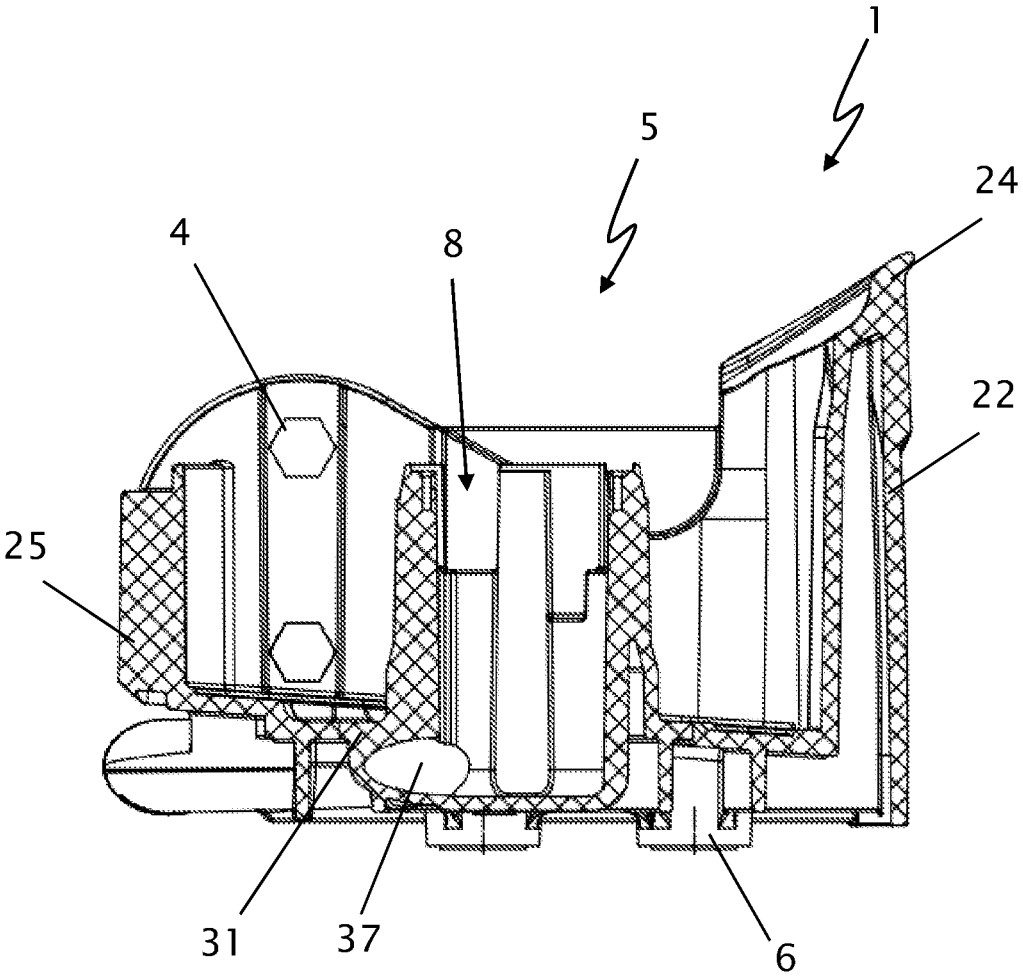
FIG. 8 shows a cross section through the embodiment of the connection bracket from FIG. 2 corresponding to section line VIII from FIG. 9.
Figure 9:
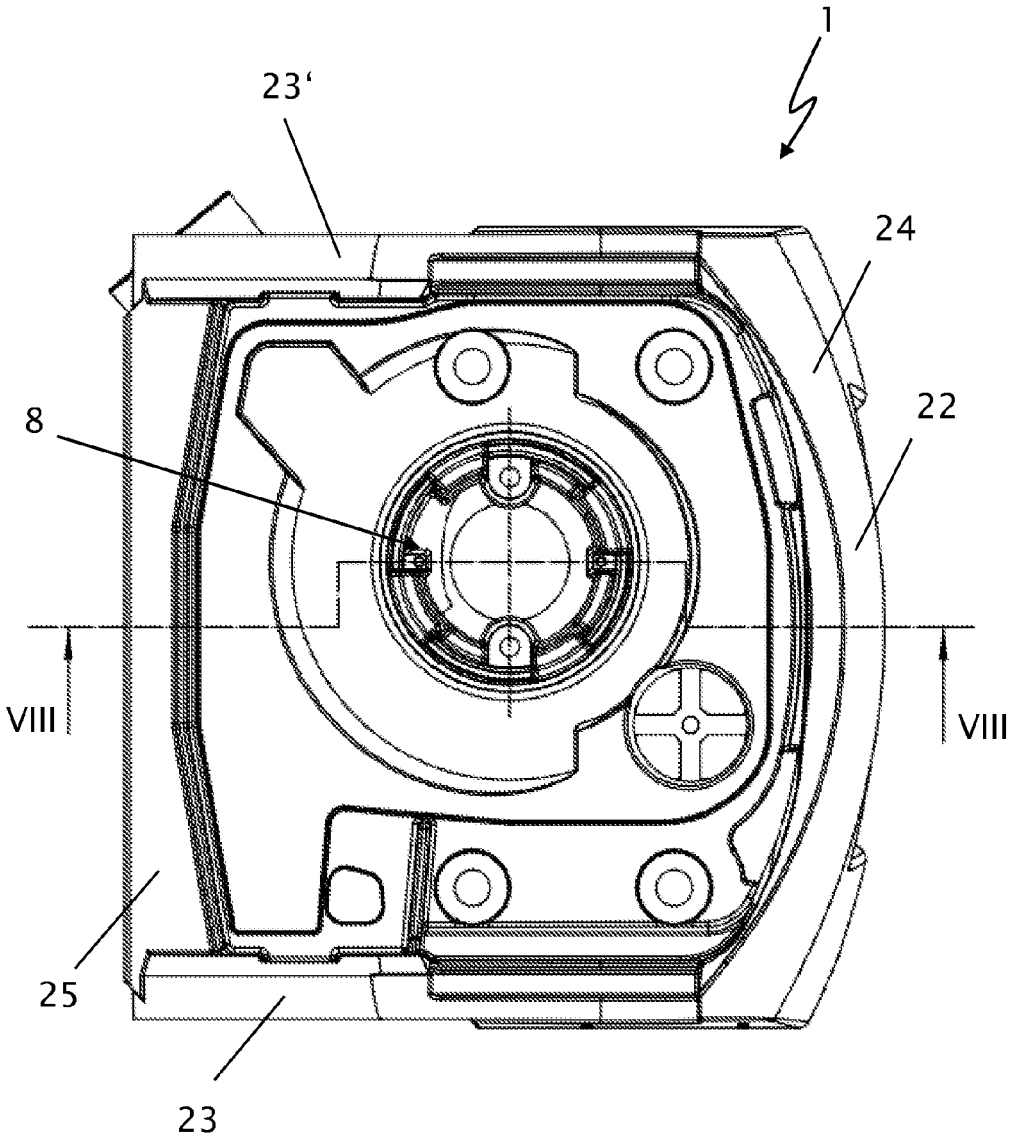
FIG. 9 shows a top view of the embodiment of the connection bracket from FIG. 2.
Figure 10:
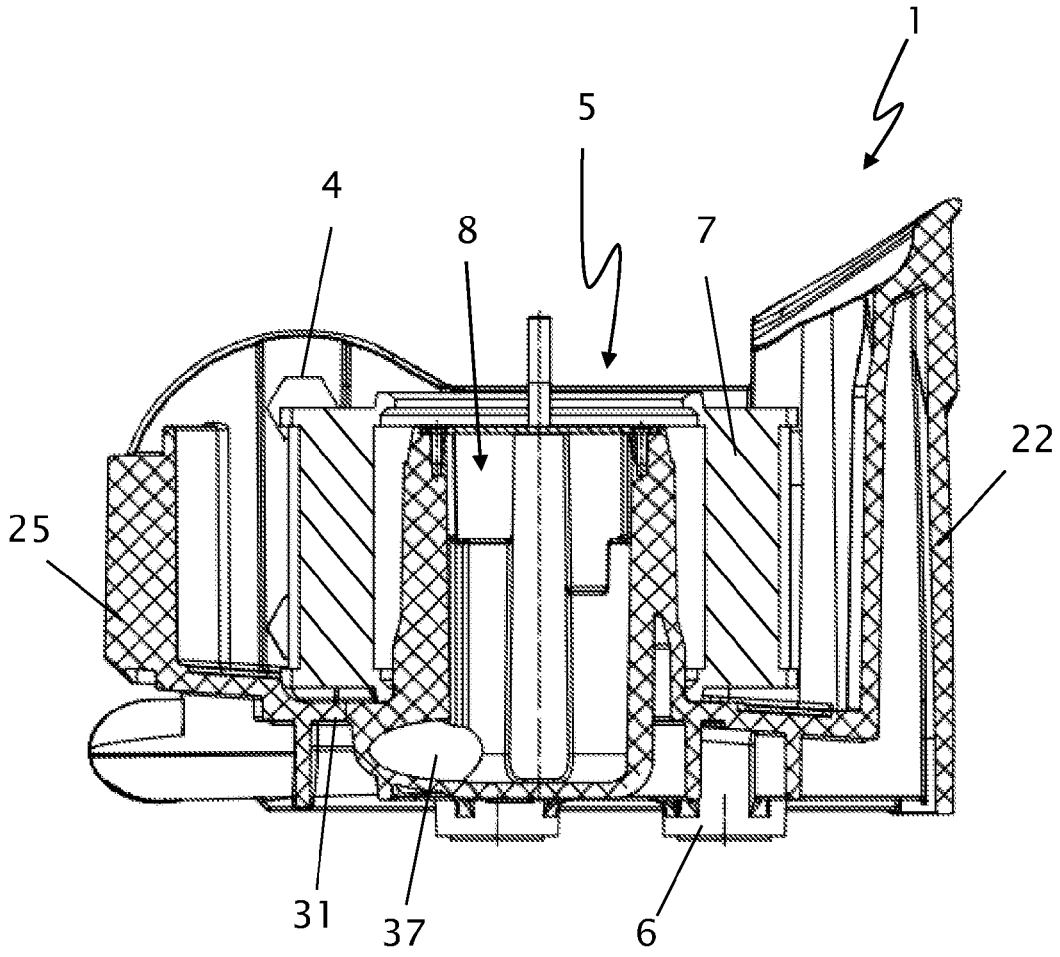
FIG. 10 shows a cross section through the embodiment of the connection bracket from FIG. 2 according to the section line from FIG. 11 having inserted air filter system.
Figure 11:
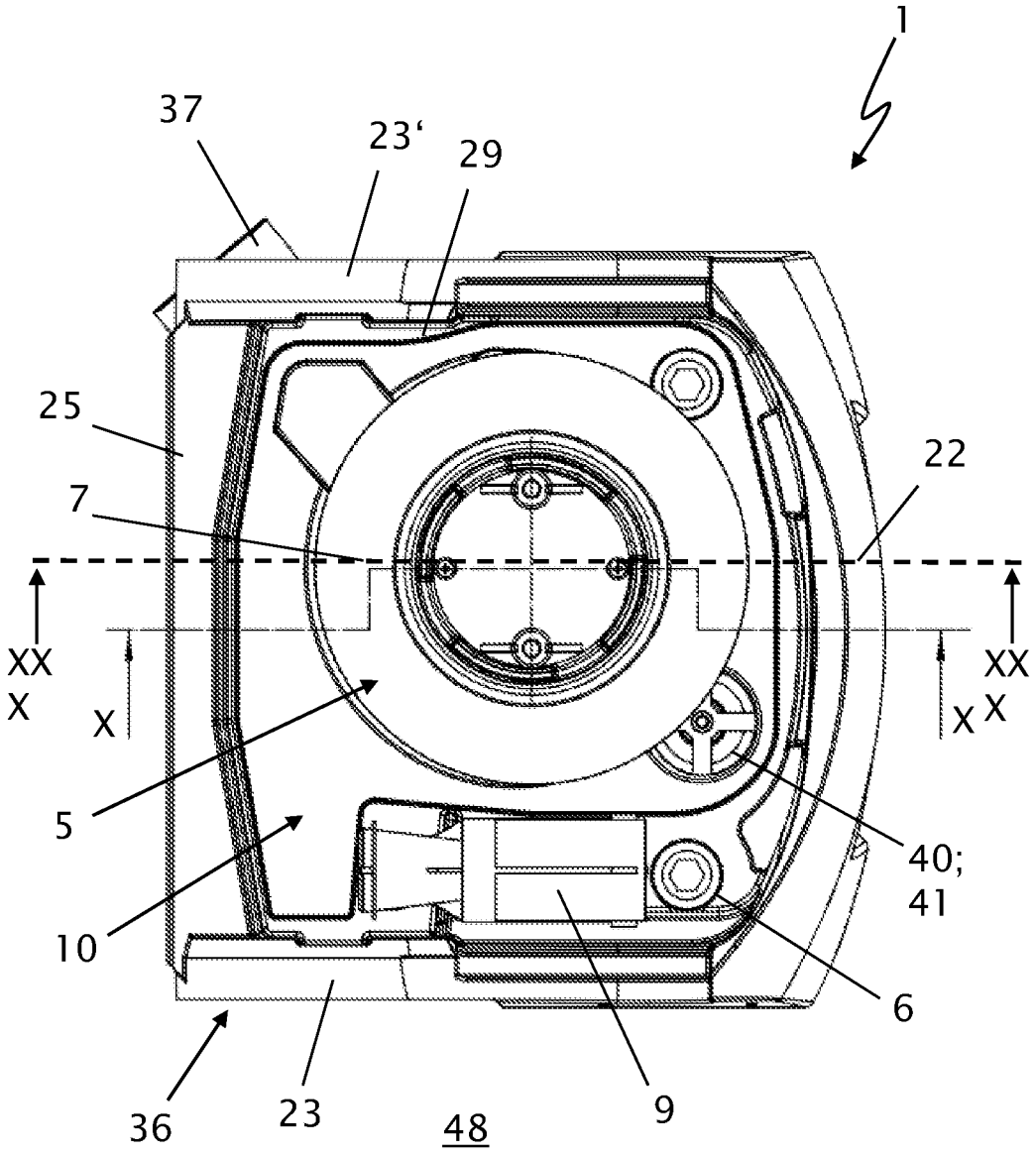
FIG. 11 shows a top view of the embodiment of the connection bracket from FIG. 9 having inserted air filter system.

As is apparent in FIGS. 6 and 7, the connection bracket 1 has a rib structure 28 made of multiple adjacent honeycombs 32. The individual honeycombs 32 are formed by honeycomb walls 30, which form the rib structure 28 as partially common honeycomb walls. The result is a very light but nonetheless stiff component, which is elastically optimized with respect to the vibration loads.

This is similarly true for the corresponding mounts, namely the guide element mount 4 or the drive element mount 6, in which the stiffness required for introducing and dissipating active loads is also formed by a rib structure having honeycomb walls 30.

While the present invention has been illustrated by description of various embodiments and while those embodiments have been described in considerable detail, it is not the intention of Applicant to restrict or in any way limit the scope of the appended claims to such details. Additional advantages and modifications will readily appear to those skilled in the art. The invention in its broader aspects is therefore not limited to the specific details and illustrative examples shown and described. Accordingly, departures may be made from such details without departing from the spirit or scope of Applicants' invention.

What is claimed is:

1. In combination, a tamping device; and a connection bracket supported by the tamping device, the connection bracket comprising:

a frame, a guide element mount, and a drive element mount, wherein the connection bracket has a guide unit implemented integrally therewith for combustion air.

2. The combination according to claim 1, wherein the guide unit for combustion air comprises an air filter attachment.

3. The combination according to claim 2, wherein the frame is implemented so that it at least partially bounds a receptacle space, in which the air filter attachment is arranged.

4. The combination according to claim 1, wherein the frame is implemented so that it forms a substantial part of an air filter housing.

5. The combination according to claim 3, wherein the frame is implemented so that the receptacle space at least partially enclosed thereby is closable using a cover.

6. The combination according to claim 5, wherein the frame has at least one protective wall, implemented as double-walled which protrudes at least partially beyond the cover when the receptacle space is closed.

7. The combination according to claim 1, wherein the frame has a rib structure.

8. The combination according to claim 1, wherein the connection bracket comprises an air guiding unit for discharging the filtered air.

9. The combination according to claim 8, wherein the frame has a rib structure comprising a plurality of honeycomb walls connected to one another and the air guiding unit is at least partially formed by the honeycomb walls.

10. The combination according to claim 1, wherein the connection bracket substantially consists of plastic.

11. The combination according to claim 1, wherein the connection bracket is an injection-molded part.

12. An injection mold for producing a connection bracket according to the combination of claim 11.

13. A method for producing a connection bracket according to the combination of claim 1, wherein the connection bracket is produced by means of injection molding.

14. A method for assembling a tamping device according to the combination of claim 1, wherein the connection bracket, the guide element mount, the drive element mount, and the guide unit for combustion air are positioned simultaneously with the installation of the connection bracket.

15. The combination according to claim 2, wherein the air filter attachment comprises an air filter socket.

16. The combination according to claim 5, wherein the cover comprises a plastic cover.

17. The combination according to claim 7, wherein the rib structure comprises a plurality of honeycomb walls connected to one another.

18. The combination according to claim 10, wherein the plastic comprises a thermoplastic.

19. The combination according to claim 1, wherein the tamping device comprises a vibration damper.

* * * * *